United States Patent [19]

Tashiro et al.

[11] 3,967,154

[45] June 29, 1976

[54] MAGNETRON HAVING HORIZONTALLY BLOWN TYPE RADIATOR

[75] Inventors: Norio Tashiro, Yokohama; Hiroshi Miura, Tokyo, both of Japan

[73] Assignee: Tokyo Shibaura Electric Co., Ltd., Kawasaki, Japan

[22] Filed: Jan. 2, 1975

[21] Appl. No.: 538,113

[30] Foreign Application Priority Data

Jan. 11, 1974 Japan ..... 49-6787[U]

[52] U.S. Cl. ..... 315/39.51; 315/39.53; 315/39.71; 219/10.55 R

[51] Int. Cl.[2] ..... H01J 25/50

[58] Field of Search ..... 315/39.51, 39.53, 39.71; 219/10.55

[56] References Cited

UNITED STATES PATENTS

| | | | |
|---|---|---|---|
| 3,020,447 | 2/1962 | Schall et al. | 315/39.51 X |
| 3,304,400 | 2/1967 | Ojelid | 315/39.71 X |
| 3,315,121 | 4/1967 | Staats | 315/39.51 |
| 3,493,810 | 2/1970 | Valles | 315/39.51 |
| 3,577,033 | 5/1971 | Aoki et al. | 315/39.71 |
| 3,794,879 | 2/1974 | Edwards | 315/39.51 |
| 3,809,950 | 5/1974 | Koinuma | 315/39.51 |
| 3,859,558 | 1/1975 | Harada et al. | 315/39.51 |

*Primary Examiner*—Saxfield Chatmon, Jr.
*Attorney, Agent, or Firm*—Oblon, Fisher, Spivak, McClelland & Maier

[57] ABSTRACT

A magnetron includes a "horizontally blow" type radiator consisting of a plurality of cooling plates press fitted one over the other over the outer periphery of a cylindrical anode member to permit a cooling wind to be blown in a direction to intersect the axis of the anode member, and a cooling wind guide for guiding toward the radiator the cooling wind blown, in the direction of the axis of the anode member, from the side of a cathode stem extending from one side of the anode member.

7 Claims, 5 Drawing Figures

MAGNETRON HAVING HORIZONTALLY BLOWN TYPE RADIATOR

This invention relates to a magnetron and, in particular, to a magnetron including "horizontally blown" type radiator capable of cooling a cathode stem.

As a radiator for an air cooling type magnetron use is made of a "horizontally blown" type radiator in which a cooling wind is blown in the horizontal direction of the magnetron and a "vertically blown" type radiator in which a cooling wind is blown in the vertical direction of the magnetron. The horizontally blown type radiator of the magnetron consists of a plurality of cooling plates arranged one over the other on the outer periphery of a cylindrical anode member in a direction to intersect the axis of the anode member. The cooling plates have openings, respectively, at the center through which they are press fitted one over the other on the outer periphery of the anode member. The radiator of this type is most suitable for mass production. Consequently, the magnetron having such "horizontally blown" type radiator is suitable from the standpoint of mass production. With such magnetron, however, a cathode stem is not sufficiently cooled, since a cooling wind is not blown onto a cathode stem. With a magnetron having such "vertically blown" type radiator, on the other hand, a cathode stem can be sufficiently cooled, since a cooling wind is sufficiently blown onto the cathode stem and radiator. However, a plurality of cooling plates constituting the radiator are required to be arranged in the axial direction of an anode member and, therefore, they are required to be soldered, brazed or bonded by an adhesive such as epoxy resin etc. to the anode member, thus making it difficult to mass produce magnetrons. Furthermore, the magnetron is of a strut type in which a pair of magnets for generating magnetic field are arranged one at each side of a magnetron body. The magnetron of this type is, therefore, apt to be increased in dimension. In contrast, the magnetron having the "horizontally blown" type radiator is of a shell type in which a pair of magnets are arranged one at the upper end and one at the lower end of the magnetron body. The magnetron of this type can be made relatively small in dimension and, moreover, it is desirable, in view of the above-mentioned reasons, in its manufacture and its usage. There remains, however, the problem that the cathode stem is not sufficiently cooled.

It is accordingly the object of this invention to provide a magnetron having a "horizontally blown" type radiator capable of cooling a cathode stem.

According to this invention, a plurality of cooling plates constituting a radiator are arranged one over the other on the outer periphery of an anode member of a magnetron body in a manner to intersect the axis of the magnetron body. A cooling wind guide surrounds the magnetron body and radiator and has a cooling wind passage for guiding toward the radiator a cooling wind blown from the side of a cathode stem of the magnetron and an outlet for discharging the cooling wind passed through the radiator.

This invention will be further described by way of example by reference to the accompanying drawings, in which.

Figure 1:
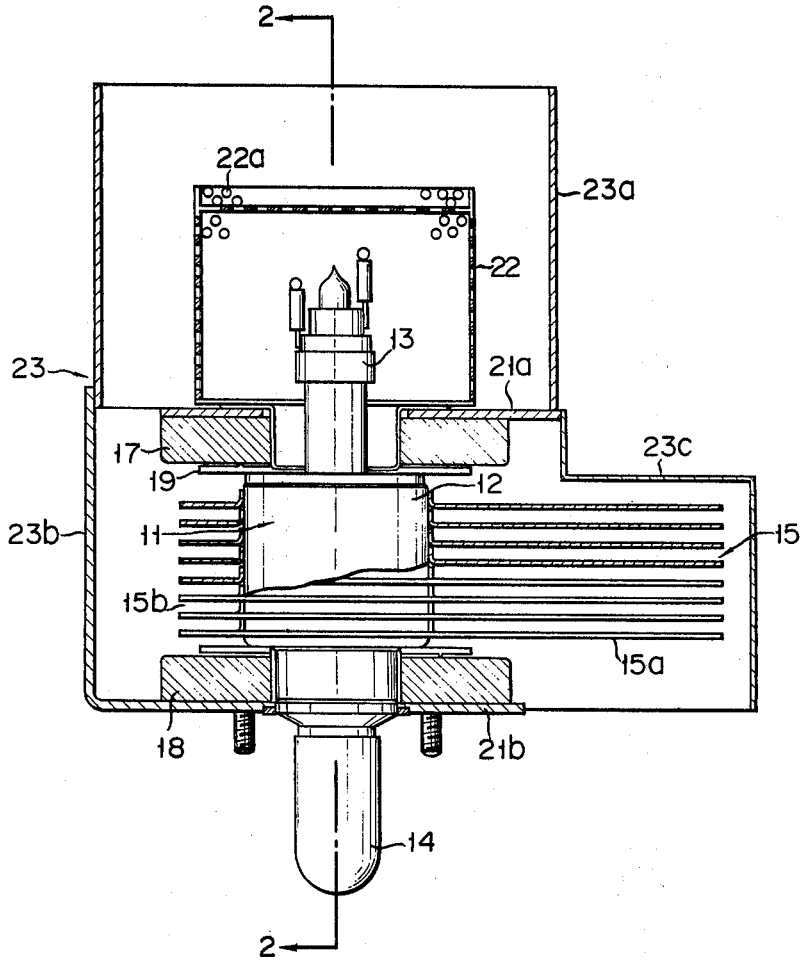
FIG. 1 is a cross-sectional view showing a shell-type magnetron according to one embodiment of this invention.
Figure 3:
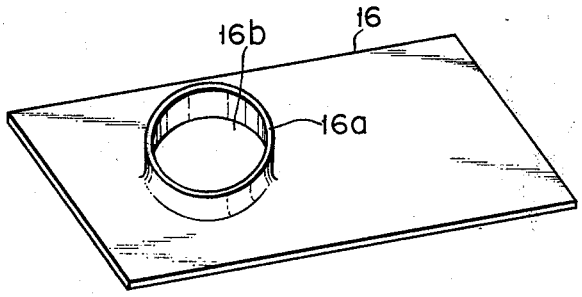
FIG. 3 is a perspective view showing a cooling plate of a radiator of the magnetron of FIG. 1.
Figure 2:
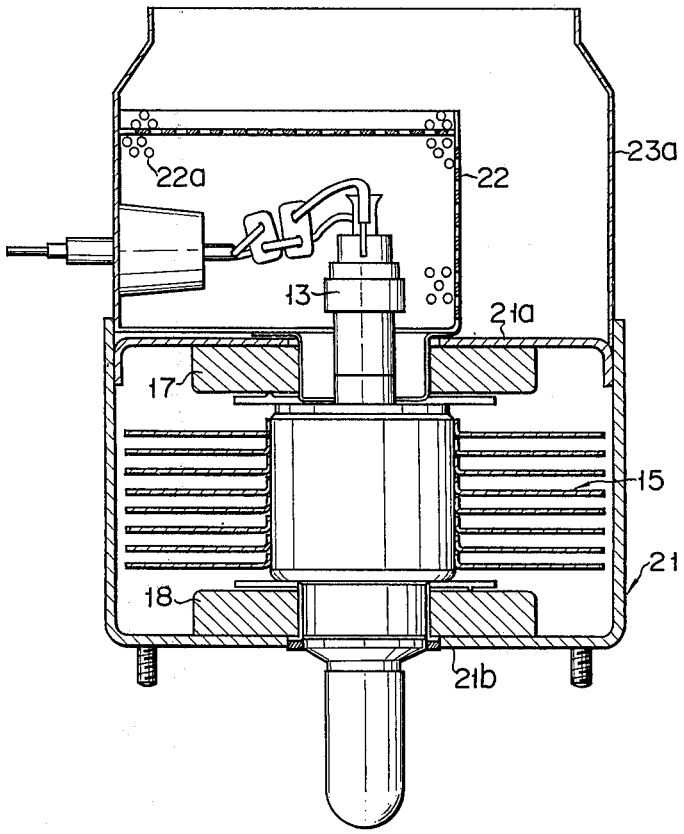
FIG. 2 is a cross-sectional view as taken along line 2—2 of FIG. 1.

In FIGS. 1 and 2, a magnetron body 11 includes a cylindrical anode member 12, a cathode stem 13 extending from one end of the anode member 12 and an antenna section 14 extending from the other end of the anode member 12. Around the outer periphery of the anode member is provided a radiator 15. The radiator 15 is comprised of a plurality of cooling plates 16. The respective cooling plate 16 consists of a rectangular metal plate including a cylindrical wall **16*a* which is provided, as shown in FIG. 3, near to one end of the rectangular plate as viewed from the longitudinal direction thereof and has a circular opening 16*b* whose diameter is substantially the same as that of the anode member. The cooling plates 16 are arranged one over the other on the outer periphery of the anode member by press fitting these cooling plates over the anode member. The cathode stem 13 is mounted through a doughnut-shaped permanent magnet 17 and shim plate 19 on the anode member, while the antenna section 14 is mounted through a doughnut-shaped permanent magnet 18 and shim plate 20 on the anode member. In an attempt to magnetically couple these permanent magnets 17 and 18 a rectangular cross-section yoke 21 is provided in a manner to surround the magnets 17 and 18**.

The yoke 21 comprises an upper yoke plate **21*a* mounted in a manner to be contacted with the upper surface of the magnet 17 and a U-shaped lower yoke member 21*a* mounted in a manner to be contacted with the lower surface of the magnet 18. At a side corresponding to the longer side 15*a* of the radiator 15 the upper yoke plate 21*a* has one end portion extending outwardly of the outer periphery of the magnet 17 and the other end portion located in substantially the same plane as the outer periphery of the magnet 17**.

The cathode stem 13 is housed within a shield box 22 for preventing a microwave energy radiated from the cathode stem 13 from being leaked outside. The shield box 22 is bored with a plurality of holes **22*a*. A guide 23 is provided for guiding a cooling wind from above toward the radiator 15 of the magnetron. The guide 23 comprises a rectangular cross-section inlet guide 23*a* through which the cooling wind is blown, and a guide plate 23*b* connected to one wall of the inlet guide 23*a* and adapted to guide the cooling wind coming from the inlet guide 23*b*. The guide plate 23*b* stands upright at a predetermined interval from the outer periphery of the magnet 17 and is connected integrally to the end of the bottom of the lower yoke member 21*b*. As a result, a cooling wind passage is defined between the guide plate and the magnetron. A U-shaped outlet guide 23*c* for discharging the cooling wind is provided at the forward end of the longer side 15*a* of the radiator 15**.

When a cooling wind is blown into the inlet guide **23*a* of the magnetron, it passes through the holes 22*a* of the shield box 22 to cool the cathode stem 13, while at the same time it passes through the cooling wind passage to a shorter side 15*b* of the radiator 15** and discharged through the radiator toward the outlet, thereby cooling the radiator or the magnetron body.

Figure 5:
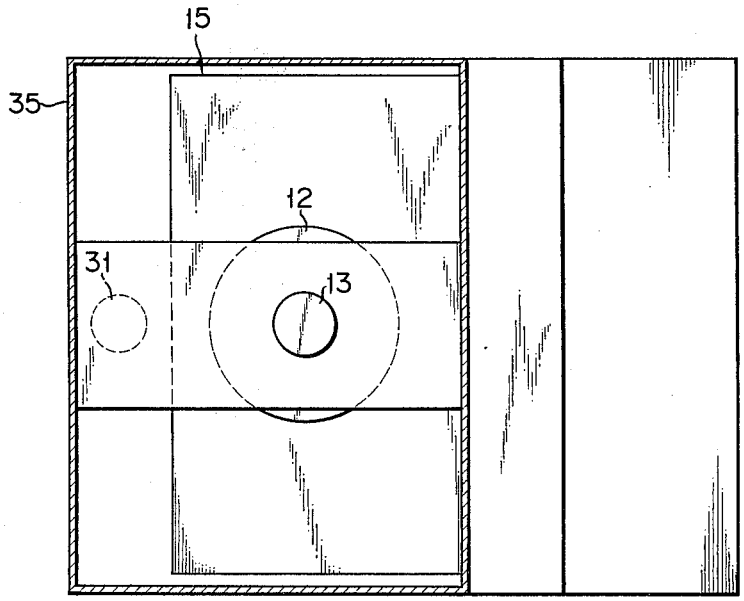
FIG. 5 is a cross-sectional view as taken along line 5—5 of FIG. 4.
Figure 4:
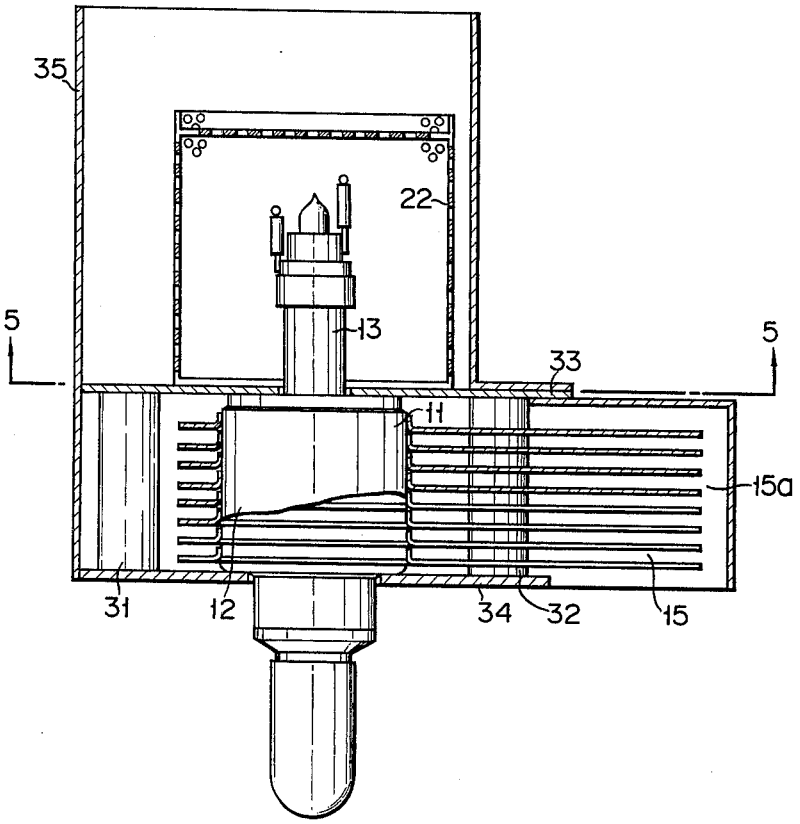
FIG. 4 is a cross-sectional view showing a strut-type magnetron according to another embodiment of this invention.

According to this invention the cathode stem can be sufficiently cooled using a "horizontally blown" type radiator most suitable for mass production. Though with the above-mentioned embodiment use is made of the shell-type magnetron in which the pair of permanent magnets are disposed one at the upper end and one at the lower end of the magnetron body, this invention can be applied equally to a strut type magnetron in which a pair of bar-like magnets are disposed one at each side of a magnetron body. Namely, a pair of bar-like magnets 31, 32 disposed at each side of the magnetron body 11 are magnetically coupled to each other by upper and lower yoke plates 33 and 34, as shown in FIG. 4. As shown in FIG. 5, the upper yoke plate 33 is made somewhat narrower in width than the diameter of the cylindrical anode member 12 of the magnetron body 11, and the lower yoke plate 34 is made somewhat greater in width than the diameter of the radiator 15. A rectangular cross-sectional cooling wind guide 35 houses the strut type magnetron. At the longer side 15*a* of the radiator, a guide outlet for discharging a cooling wind is provided in the cooling wind guide 35.

When a cooling wind is blown into the cooling wind guide of the magnetron, it passes through the holes 22*a* of the shield box surrounding the cathode stem 13, to cool the cathode stem, while at the same time it passes through a cooling wind passage to cool the radiator 15. As a result, the cathode stem 13 and radiator 15 and, in consequence, the anode member 12 are effectively cooled.

What we claim is:

1. A magnetron comprising a magnetron body having an anode member, a cathode stem projecting from one end of the anode member, and an antenna section projecting from the other end of the anode member; a pair of permanent magnets oppositely disposed to impart a magnetic field to the magnetron body; a yoke for magnetically coupling the permanent magnets to each other; a radiator mounted on the outer periphery of the anode member of the magnetron body and having a plurality of cooling plates superposed in a direction to intersect the axis of the anode member; and a cooling wind guide having a wind inlet guide receiving a cooling wind blown in an axial direction of the magnetron body from the side of the cathode stem and surrounding the cathode stem and a cooling wind passage disposed in communication with the wind inlet guide in the axial direction of the magnetron body for guiding the cooling wind toward the radiator and an outlet from which the cooling wind passed through the radiator is discharged crosswise of the axis of the magnetron body.

2. A magnetron comprising a magnetron body having a cylindrical anode member, a cathode stem projecting from one end of the anode member and an antenna section projecting from the other end of the anode member; a pair of permanent magnets oppositely disposed one at each end of the anode member of the magnetron body; a yoke for surrounding the magnets so as to magnetically couple the magnets to each other; a radiator mounted on the outer periphery of the anode member of the magnetron body and having a plurality of cooling plates superposed in a direction to intersect the axis of the anode member; and a cooling wind guide having a wind inlet guide receiving a cooling wind blown in an axial direction of the magnetron body from the side of the cathode stem and surrounding the cathode stem and a cooling wind passage disposed in communication with the wind inlet guide in the axial direction of the magnetron body for guiding the cooling wind toward the radiator, and an outlet from which the cooling wind passed through the radiator is discharged crosswise of the axis of the magnetron body.

3. A magnetron according to claim 2, in which said radiator comprises a plurality of rectangular cooling plates having a cylindrical wall provided in proximity to one end thereof as viewed from the longitudinal direction thereof and press fitted over the outer periphery of the anode member.

4. A magnetron according to claim 2, in which there is further provided a microwave energy shielding box provided within said inlet guide in a manner to substantially completely surround the cathode stem having a plurality of holes through which the cooling wind is passed.

5. A magnetron according to claim 2, in which said yoke has a rectangular cross-section and is connected to the guide plate to constitute part of the cooling wind guide.

6. A magnetron comprising a magnetron body having a cylindrical anode member, a cathode stem projecting from one end of the anode member and an antenna section projecting from the other end of the anode member; a pair of rod-like magnets disposed one at each end of the magnetron body; a yoke for magnetically coupling the rod-like magnets to each other; a radiator including a plurality of cooling plates press fitted over the outer periphery of the anode member in a manner to intersect the axis of the anode member; and a cooling wind guide having a wind inlet guide receiving a cooling wind blown in an axial direction of the magnetron body from the side of the cathode stem and surrounding the cathode stem and a cooling wind passage disposed in communication with the wind inlet guide in the axial direction of the magnetron body for guiding the cooling wind toward the radiator and a guide outlet from which the cooling wind passed through the radiator is discharged crosswise of the axis of the magnetron body.

7. A magnetron according to claim 6, in which said cooling wind guide surrounds the cathode stem and radiator and has an outlet for discharging the cooling wind.

* * * * *